United States Patent [19]

Leifeld et al.

[11] Patent Number: 4,951,359

[45] Date of Patent: Aug. 28, 1990

[54] METHOD FOR IMPROVING THE CARDING PROCESS OF A CARD OR A ROLLER CARD UNIT

[75] Inventors: Ferdinand Leifeld, Kempen; Fritz Hösel, Mönchengladbach, both of Fed. Rep. of Germany

[73] Assignee: Trüzschler GmbH & Co. KG, Mönchengladbach, Fed. Rep. of Germany

[21] Appl. No.: 333,826

[22] Filed: Apr. 4, 1989

Related U.S. Application Data

[63] Continuation-in-part of Ser. No. 170,132, Mar. 14, 1988, abandoned.

[30] Foreign Application Priority Data

Mar. 13, 1987 [DE] Fed. Rep. of Germany ..... 3708211

[51] Int. Cl.[5] ..... D01G 15/36

[52] U.S. Cl. ..... 19/98; 19/106 R; 19/105

[58] Field of Search ..... 19/88, 99, 105, 106

[56] References Cited

U.S. PATENT DOCUMENTS

| | | | |
|---|---|---|---|
| 4,497,086 | 2/1985 | Guse et al. | 19/105 |
| 4,566,153 | 1/1986 | Frosch | 19/98 |
| 4,669,151 | 6/1987 | Krusche | 19/98 |
| 4,742,675 | 5/1988 | Leifeld | 19/105 X |

FOREIGN PATENT DOCUMENTS

| | | |
|---|---|---|
| 0194771 | 9/1986 | European Pat. Off. . |
| 2926812 | 1/1981 | Fed. Rep. of Germany . |
| 3218114 | 12/1982 | Fed. Rep. of Germany . |
| 3507242 | 11/1985 | Fed. Rep. of Germany . |
| 0522051 | 6/1972 | Switzerland . |
| 1122113 | 7/1968 | United Kingdom . |
| 1288475 | 9/1972 | United Kingdom . |
| 1404761 | 9/1975 | United Kingdom . |

OTHER PUBLICATIONS

Schumacher, "Gleichstromantriebe in der Baumwollspinnerei und Spinnereivorbereitung" Sep. 1979, p. 56, Textelbetrieb.

Becker, Interkama 80, Bericht über den 8. Internationalen Kongress mit Ausstellung für mess-und Automatisierungstechnik VDI-Z 123, 1981 pp. 15-21.

*Primary Examiner*—Werner H. Schroeder
*Assistant Examiner*—Ismael Izaguirre
*Attorney, Agent, or Firm*—Spencer & Frank

[57] ABSTRACT

A carding machine has a main carding cylinder, an electromotor drivingly connected to the carding cylinder and a control device, including a memory, for controlling the rpm of the carding cyliner. The main carding cylinder has a starting phase during which the main carding cylinder is accelerated to a working rpm and a stopping phase during which the main carding cylinder is decelerated from a working rpm to standstill. The method of operating the carding machine includes the steps of storing in the memory material-specific sets of rpm values for the starting phase and sets of rpm values for the stopping phase; and controlling the rpm of the main carding cylinder in the starting and stopping phases by the control device in accordance with respective rpm values stored in the memory.

2 Claims, 2 Drawing Sheets

METHOD FOR IMPROVING THE CARDING PROCESS OF A CARD OR A ROLLER CARD UNIT

This application is a continuation-in-part of application Ser. No. 07/170,132, filed March 14, 1988 now abandoned.

BACKGROUND OF THE INVENTION

This invention relates to a method of improving the carding process in a card or a roller card unit wherein the carding cylinder is rotated by an electric drive motor and wherein the card operates in a working phase which is between an acceleration (start-up) phase and a deceleration (braking) phase.

In a known method the working rpm of the carding cylinder is fixed for determined types of fiber. Upon changing the fiber type, for example, from cotton to chemical fibers or conversely, the working rpm is changed by changing the mechanical transmission ratio between the drive motor and. the carding cylinder. This is effected, for example, by replacing the belt pulleys of appropriate diameter. Such an adjusting operation involves significant labor and delay, and only predetermined rpm changes are possible, dependent upon the structural design (stages) of the step-up or step-down arrangements. It is a further disadvantage of the known; arrangements that upon the inertia run of the cylinder, for example, upon braking following an interruption in operation, a larger quantity of fiber will accumulate on the cylinder than in the normal operational phase. This causes irregularities which, during the restart, may lead to a rupture in the fiber web or sliver. Even if such a rupture does not take place, a certain length of the web or sliver has to be removed to eliminate the above-noted irregularities. This makes unfeasible an automatic restart (re-threading) of the material, and thus losses of material will occur. The known arrangement utilizes a non-regulated drive motor, that is, during the processing of the fiber material, no rpm variation of the carding cylinder is intended because of the large inertia thereof. As a result, at the intended cylinder rpm too many fiber neps may remain in the fiber material.

It has been proposed to provide a switching unit in the current supply circuit for the drive motor of the licker-in/cylinder drive. By means of the switching unit a start-up or brake regulator circuit equipped with an a.c. setter may be operatively connected to the circuit of the motor for the licker-in/cylinder drive. The regulator may be disconnected after the start-up or braking step. With such an arrangement it is possible only to effect at the carding cylinder a constant acceleration or deceleration of the start-up or braking processes. There results a two-stage drive in which after the acceleration there is effected a switchover to the line current drive; that is, during the start-up or braking process a purposeful setting of predetermined rpm's is not intended and during the normal operating phase (line current supply) a variation of the cylinder rpm is not feasible at all.

SUMMARY OF THE INVENTION

It is an object of the invention to provide an improved method of the above-outlined type from which the discussed disadvantages are eliminated and which, in particular, achieves a simple and rapid adaptation of the working rpm of the carding cylinder when the type of fiber material is changed and further, which makes feasible a restart of the card without severing the fiber web or sliver and reduces the nep number in the fiber.

This object and others to become apparent as the specification progresses, are accomplished by the invention, according to which, briefly stated, the carding machine has a main carding cylinder, an electromotor drivingly connected to the carding cylinder and a control device, including a memory, for controlling the rpm of the carding cylinder. The main carding cylinder has a starting phase during which the main carding cylinder is accelerated to a working rpm and a stopping phase during which the main carding cylinder is decelerated from a working rpm to standstill. The method of operating the carding machine includes the steps of storing in the memory material-specific sets of rpm values for the starting phase and sets of rpm values for the stopping phase; and controlling the rpm of the main carding cylinder in the starting and stopping phases by the control device in accordance with respective rpm values stored in the memory.

By virtue of the invention an improvement of the carding process may be achieved. Particularly there can be obtained a simple and rapid adaptation or setting of the cylinder rpm upon changing the fiber types, for example, when changing from cotton to chemical fibers. It is a further advantage of the invention that both the rpm increase and the rpm decrease of the carding cylinder are controlled in a predetermined manner As a result, during acceleration and deceleration a fiber deposition of the same thickness is obtained as during the normal operating phase so that a restart of the card (re-threading of the fiber) after an interruption may be achieved without severing the fiber web or sliver or without the loss of fiber material Further, advantageously, it is feasible to set a cylinder rpm purposefully and in a predetermined manner at which most of the neps are separated from the fiber material In this manner a stepless cylinder rpm regulation and control is possible Thus, predetermined rpm's may be rapidly set in a stepless manner.

The significant advantages of the invention maybe summarized as follows:

(1) There is achieved a definitely and purposefully controlled start-up (rpm acceleration) of the carding cylinder, whereby determined rpm dependencies with respect to other rotary rollers of the card, such as the feed roller, the doffer, and the like may be established. This circumstance is of particular advantage in connection with an automatic start (thread-in) of the fiber web and a start-up run without severing the fiber web after an interruption.

(2) There is achieved a defined and braked deceleration of the carding cylinder By virtue of the integrated braking possibility, a separate braking device may be dispensed with. Further, this possibility too, is of particular importance for a restart of the operation without severing the fiber web.

(3) There is achieved a material-specific working rpm which is coordinated with other drives in addition to the carding cylinder. In this manner, for each fiber material the optimal, quality-dependent rpm may be set and the card may be operated in a reproducible manner.

Further advantageous additional features of the invention are as follows:

The electromotor is a d.c. motor or, preferably a frequency-controlled, three-phase squirrel cage motor. The electromotor is constantly accelerated or decelerated. The drive motor of the carding cylinder is connected with an rpm-regulating device which can generate either a predetermined rpm increase sequence or an rpm decrease (braking) sequence of the carding cylinder. Preferably, the rpm-regulating device comprises a static frequency changer. The rpm-regulating device is coupled with a control device. The control device, for example, a microcomputer control system, applies rpm data to the regulating device as a function of the momentary requirements. The microcomputer of the control device may be a TMS model manufactured by Trützschler GmbH & Co. KG, Mönchengladbach, Federal Republic of Germany. The control device has a residual memory for predetermined, material-specific cylinder rpm's. In the residual memory, the determined optimal material-specific data are stored once, with respect to the required rpm increase or rpm decrease of the main cylinder. Such data may be recalled automatically according to requirements at any time practically without additional work input. The control device further is equipped with respective units for the manual and automatic setting for data input, coordination and correction. Expediently, the control unit is so designed that it can deliver, control and correct predetermined rpm's for all other drives.

DESCRIPTION OF THE PREFERRED EMBODIMENT

Figure 1:
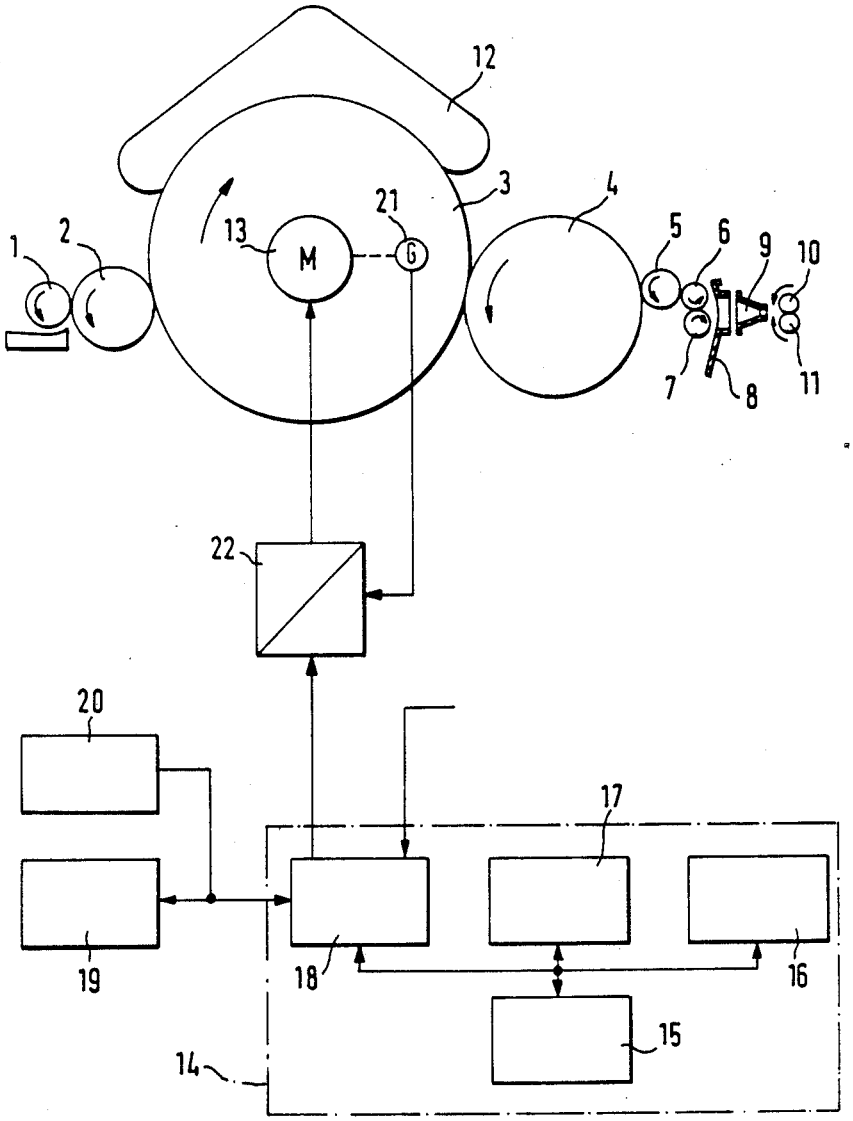
FIG. 1 is a schematic side elevational view and a block diagram of principal components of a carding machine for practicing the method according to the invention.

Turning to FIG. 1, there is schematically shown, in side elevation, a carding machine which may be, for example, an EXACTACARD DK 715 model, manufactured by Trützschler GmbH & Co. KG. The card has a feed roller 1, a licker-in 2, a main carding cylinder 3, a doffer 4, a stripper roller 5, crushing rollers 6, 7, a web guiding element 8, a sliver trumpet 9, calender rollers 10, 11 and travelling flats 12. The arrows drawn into the roller components 1–7, 10 and 11 indicate the directions of rotation.

The carding cylinder 3 is connected with an electric drive motor constituted by an rpm-controlled electromotor 13 which is operatively connected with a control apparatus 14 for setting predetermined rpm's.

The control apparatus 14 comprises a microprocessor 15 which constitutes a central processing unit and which is coupled with memories 16 and 17 and with an interface 18. The control components 15–18 form together a microcomputer. The memory 16 stores the data which relate to the actual production program and which are applied by an operator via a keyboard 19.

According to the invention, the starting rpm acceleration from zero rpm to the working rpm and a stopping acceleration from the working rpm to a standstill of the carding cylinder 3 are tightly controlled throughout the acceleration or declaration phase by the apparatus 14 in accordance with values previously inputted and stored in the memory 16. Such a control is of particular significance, for example, during the restarting of the card to ensure that the fiber material momentarily situated on the carding cylinder does not tear away from the fiber mass upstream or downstream of the carding cylinder. The permissible safe tension to which the fiber material extending between the carding cylinder and an adjacent roller (for example, the doffer 4) can be exposed is material-specific and consequently, for various materials different sets of rpm values are stored in the memory 16 and called during operation of the card. Thus, for different materials, a different smooth curve representing rpm values against elapsed time may be obtained. Advantageously, the smooth curve has a progressively decreasing slope towards the working rpm in the starting (acceleration) phase and towards standstill (zero rpm) in the stopping (deceleration) phase.

According to a preferred embodiment, the rpm values for the carding cylinder 3 are first determined as a function of the rpm of the doffer 4 and then the value pairs, each containing a doffer rpm and a cylinder rpm are stored, for example, to generate a smooth desired deceleration of the carding cylinder 3. Thus, starting from a doffer rpm of 200, there may be associated therewith a cylinder rpm of 350 and, to generate the entire pair set, the doffer rpm is, until it reaches zero, reduced by one while the cylinder rpm is, at the same time, reduced by five to obtain the individual deceleration rpm's for the stopping phase for a predetermined fiber material. The rpm pairs of the set are then stored in the memory 16 by means of the keyboard 19. For the starting phase a set of associated doffer rpm's and carding cylinder rpm's are similarly obtained and stored in the memory 16.

According to another preferred embodiment, the individual rpm values of the carding cylinder 3 from zero to the working rpm (acceleration) or from the working rpm to stoppage (deceleration) may be stored in the form of a material-specific formula such as, for example, a deceleration formula of $B=2A-C$ where A is the doffer rpm, B is the cylinder rpm and C is an appropriately selected constant rpm such as 50.

In the memory 17 there are stored the permanently pre-programmed data which are applicable in the process control for each production program. This concerns, among others, data which in determined operational conditions permit or suppress certain machine function, such as, for example, data which fix the permitted rpm range of the carding cylinder.

The microprocessor produces, on the one hand, all control signals required for the operation of the microcomputer and provides, on the other hand, controlled by the program in the PMEM-memory 17, all data transfers between the memories and the external circuits and devices coupled by means of the interface 18. Further, the microprocessor 15 carries out all required computations and decisions. The interface 18 which is in principle a buffer memory with input and output registers, reads into the microcomputer, upon commands therefrom, external information as inputting signals, that is, keyboard signals and signals representing the operational state of the carding machine. Further, the interface 18 applies information (commands) from the microcomputer as output signals to the external control logic circuits, display devices and the like. The external devices include a display device 20, by means of which the essential program data and, for example, also data concerning the production speed as well as other machine conditions may be indicated. Further transmitters generate signals characterizing machine conditions. Such signals, for example, indicate whether or not the carding cylinder 3 runs. Further, there is provided a production logic with coupled regulating motors for the material transport. The logic contains in automatic operation command signals from the microcomputer and controls the operation as a function of the production program.

As has been noted earlier, the production programs are inputted in the memory 16 by an inputting device such as a keyboard 19. Upon depressing a programming key, a code is produced which is read into the microprocessor 15 via the interface 18. The microprocessor 15 decides whether the code is a command for the storing, erasing or inserting of a signal or an information for the production program. In the first case, the corresponding command is performed. In case of a command signal to "store", the microprocessor 15 effects the transfer of the last-inputted data into the memory 16. In the second case, numbers or functions for further use are intermediately stored into the data memory 16.

Figure 2:
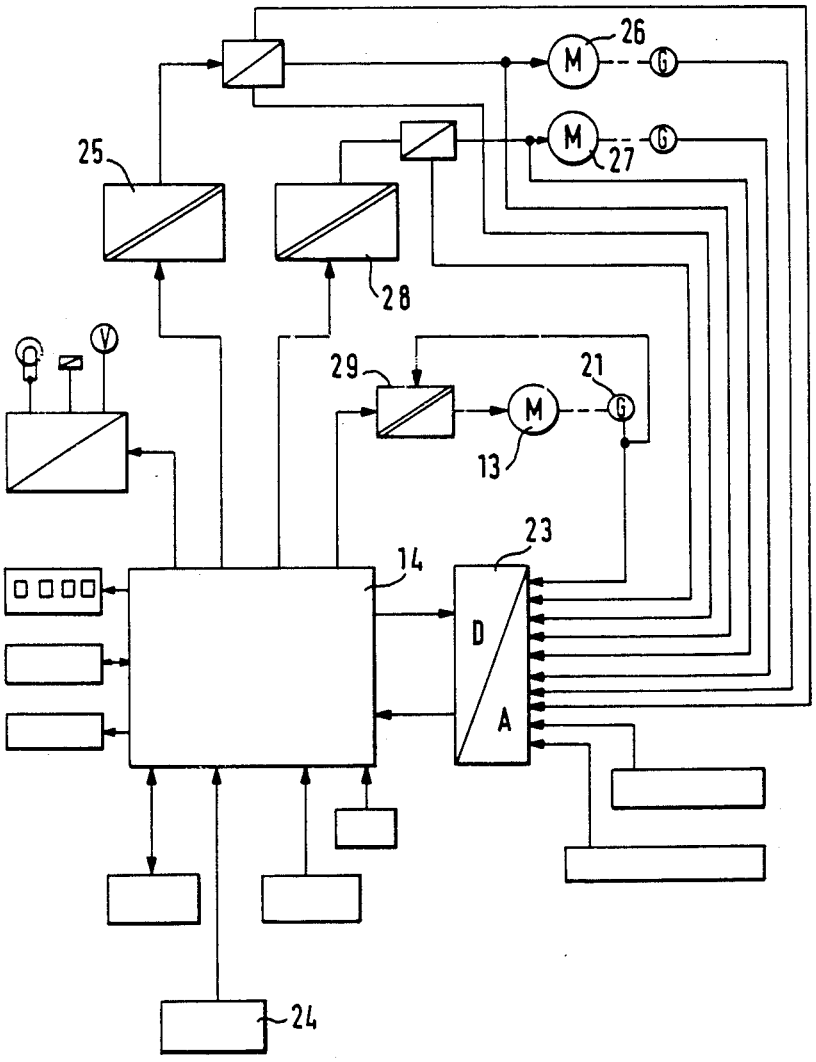
FIG. 2 is a block diagram showing additional control functions.

With the carding cylinder 3 there is associated an electronic tachogenerator 21 which serves as a measuring value receiver and which is connected with a regulating device 22 situated between the control device 14 and the drive motor 13. As shown in FIG. 2, the electronic tachogenerator 21 is connected to an analog-digital converter 23 which, in turn, is connected with the electronic control apparatus (microcomputer) 14. The analog-digital converter 23 is controlled by the microcomputer 14 which receives signals from a desired value transmitter 24. The microcomputer 14 is connected to a first digital-analog power converter 25 which is controlled by the microprocessor and which is connected with the motor 26 for the feed roller 1 of the carding machine. Further, the microcomputer 14 is coupled to a second digital-analog power converter 28 which is connected with the motor 27 for the doffer 4. Also, the microcomputer 14 is connected to a third digital-analog power converter 29 which is connected with the electric drive motor 13 for the main carding cylinder 3.

In operation, the rpm's of the carding cylinder 3 are converted by the tachogenerator 21 into analog electric signals which are, in turn, converted by the analog-digital converter 23 into digital electric signals and which constitute input signals for the microcomputer 14. From the input signals and the stored program data the microprocessor derives digital electric output signals which are, by the subsequent digital-analog power converter 29, reconverted into analog electric signals and are then applied to the electric drive motor 13 which operates the carding cylinder 3.

Reverting once again to FIG. 2, there are illustrated further elements for additional control and monitoring functions. Thus, to the analog-digital converter 23 there is connected a testing device. Further, to the analog-digital converter there is applied an analog signal derived from the fiber web thickness measuring device. The following further devices are electrically connected to the microcomputer: operating elements such as an on and off switch for the card and the like; monitoring organs which report disturbances of the system during the course of operation, a master computer for controlling a plurality of card or roller card units, a program module, by means of which variable data may be reprogrammed on one occasion or upon changes; a display device for indicating production and counter positions and a device with which signal lamps, fuses or valves may be directly controlled.

It will be understood that the above description of the present invention is susceptible to various modifications, changes and adaptations, and the same are intended to be comprehended within the meaning and range of equivalents of the appended claims.

What is claimed is:

1. A method of operating a carding machine having a main carding cylinder, an electromotor drivingly connected to said carding cylinder and a control device for controlling the rpm of the carding cylinder; a doffer cooperating with said carding cylinder and rotating at doffer rpm's; said control device including a memory; said main carding cylinder having a starting phase during which the main carding cylinder is accelerated to a working rpm and a stopping phase during which the main carding cylinder is decelerated from a working rpm to standstill; comprising the steps of (a) storing in said memory sets each formed of a series of individual values representing carding cylinder rpm's for the starting phase, serts each formed of a series of individual values representing carding cylinder rpm's for the stopping phase and sets each formed of a series of individual doffer rpm's and corresponding respective carding cylinder rpm's; each set being material-specific; and (b) controlling the rpm of said main carding cylinder in the starting and stopping phases by said control device in accordance with respective said rpm values stored in said memory.

2. A method of operating a carding machine having a main carding cylinder, an electromotor drivingly connected to said carding cylinder and a control device for controlling the rpm of the carding cylinder; a doffer cooperating with said carding cylinder; said control device including a memory; said main carding cylinder having a starting phase during which the main carding cylinder is accelerated to a working rpm and a stopping phase during which the main carding cylinder is decelerated from a working rpm to standstill; comprising the steps of (a) storing in said memory sets of rpm values for the starting phase and sets of rpm values for the stopping phase; each set being material-specific and each set being represented by a formula defining each rpm value as a function of the rpm of the doffer; said rpm of the doffer being a variable changing during said starting and stopping phases; and (b) controlling the rpm of said main carding cylinder in the starting and stopping phases by said control device in accordance with respective said rpm values stored in said memory.

* * * * *